US007214146B1

(12) United States Patent
Gersang

(10) Patent No.: US 7,214,146 B1
(45) Date of Patent: May 8, 2007

(54) PUTTING TRAINING DEVICE AND METHOD

(76) Inventor: Djapet T. Gersang, 11802 - 4th Ave. West # E-222, Everett, WA (US) 98204

( * ) Notice: Subject to any disclaimer, the term of this patent is extended or adjusted under 35 U.S.C. 154(b) by 0 days.

(21) Appl. No.: 11/192,196

(22) Filed: Jul. 27, 2005

Related U.S. Application Data

(60) Provisional application No. 60/671,803, filed on Apr. 15, 2005.

(51) Int. Cl.
*A63B 69/36* (2006.01)

(52) U.S. Cl. ..... 473/409; 473/219; 473/257

(58) Field of Classification Search ..... 473/219, 473/257, 261, 262, 266, 267, 269, 270, 268, 473/409
See application file for complete search history.

(56) References Cited

U.S. PATENT DOCUMENTS 4,434,983 A * 3/1984 Taggart ..... 473/273
4,563,010 A * 1/1986 McDorman et al. ..... 473/267
5,645,494 A * 7/1997 Dionne et al. ..... 473/278
5,827,128 A * 10/1998 Finch et al. ..... 473/267
6,669,575 B1 * 12/2003 Marlette ..... 473/270
6,869,288 B1 * 3/2005 Faulkner et al. ..... 434/252
6,945,875 B2 * 9/2005 Gauer ..... 473/270

* cited by examiner

*Primary Examiner*—Nini F. Legesse
(74) *Attorney, Agent, or Firm*—Dean A. Craine

(57) ABSTRACT

A putting training device used to teach a new method of putting that teaches the golfer to swing the putter along a target line that extends between the golfer and the hole and to adjust the angle of the putter head to match the final slope angle of the putting green. The device includes an elongated planar member with a longitudinally aligned target line indicator, a plurality of left and right swing-force indicators, and a putter head angle scale printed thereon. The planar member lays flat on the ground and is aligned so that the target line indicator is longitudinally aligned with the target line that points directly to the hole. The user then determines the final slope angle of the green and then identifies a reference line on the putter head angle scale that matches the final slope angle. The user then swings the putter with the face maintained in an opened or closed position that matches the selected reference line.

1 Claim, 4 Drawing Sheets

PUTTING TRAINING DEVICE AND METHOD

This utility patent application is based on the provisional patent application (Ser. No. 60/671,803) filed on Apr. 15, 2005.

BACKGROUND OF THE INVENTION

Field of the Invention

Description of the Related Art

The game of golf is a very difficult and challenging sport in which many individuals spend a large amount of time and energy trying to master. One of the hardest aspects of the game of golf is putting. While putting seems to be mechanically the simplest of all golf skills, very few golfers are able to master it.

The body's physical requirements for putting are minimal. A successful golfer must be able to recognize different types of slopes on a putting green and accurately judge the influence of gravity on the path of the ball as it rolls towards the hole. Good putters must learn how to 'read' different slopes and conditions on the green and then consistently adjust their putts to these conditions.

What is needed is a putting training device and method to teach golfers how to consistently and accurately putt.

SUMMARY OF THE INVENTION

It is an object of the present invention to provide a putting training device and method.

It is another object of the present invention to provide such a device used to teach a simple method of accurately putting on either flat or slopping greens.

These and other objects of the putting training device that comprises an elongated planar member made of flexible material capable of being easily folded or rolled into the golfer's pocket or golf bag. Longitudinally and centrally aligned on the top surface of the planar member is a target line indicator. Also printed on the top surface of the planar member are right and left swing force indicators, a center ball indicator, and front and rear foot position indicators. Located adjacent to the center ball indicator is a putter head angle scale.

During use, the planar member is unfolded and placed on the turf or green between the golfer's feet and the ball. The planar member is transversely aligned with the golfer so that the target line indicator is longitudinally aligned with the target line that extends from the ball to the hole. In the preferred embodiment, the center ball indicator is centrally aligned on the planar member so that when the planar member is placed adjacent to the ball, the center ball indicator is located adjacent to the ball. After setting up the planar member on the turf or green, the golfer inspects the areas on the turf and green between the ball and the hole for slopes, dips or imperfections that may impact the roll of the ball as it travels towards the hole. The golfer identifies a projected path line from the ball to the hole and any lateral slopes located thereon. The lateral slopes are added together to generate a final lateral slope. Next, the golfer identifies the slope angle reference line printed on the putter head angle scale that substantially matches the final lateral slope value. In the preferred embodiment, the putter head angle scale is divided into two scales, an open head scale and a closed angle head scale, that are centrally aligned around a single reference point. In the preferred embodiment, the reference point is aligned with the center ball indicator.

Next, the golfer inspects the areas on the turf and green along the projected path line for one or more longitudinal slopes that may increase or decrease the speed of the ball as it travels to the hole. The golfer also takes into consideration the texture of the turf or grass, the wind and moisture and its impact on the amount of force needed to roll the ball towards the hole. With this information, the golfer determines the amount of force needed to be applied to the ball.

After all of the above factors have been identified, the golfer then positions himself or herself perpendicular on the side of the planar member opposite the ball. He or she then aligns the face of the putter with the proper slope angle reference line on the open or closed head scales. The golfer grips the handle so that the face of the putter head is maintained at the desired slope angle as the putter is swung over the target line indicator. The golfer uses the swing force indicator to mark the rearmost point of the golfer's backswing to produce the desired impact force on the ball.

DESCRIPTION OF THE PREFERRED EMBODIMENT(S)

Figure 1:
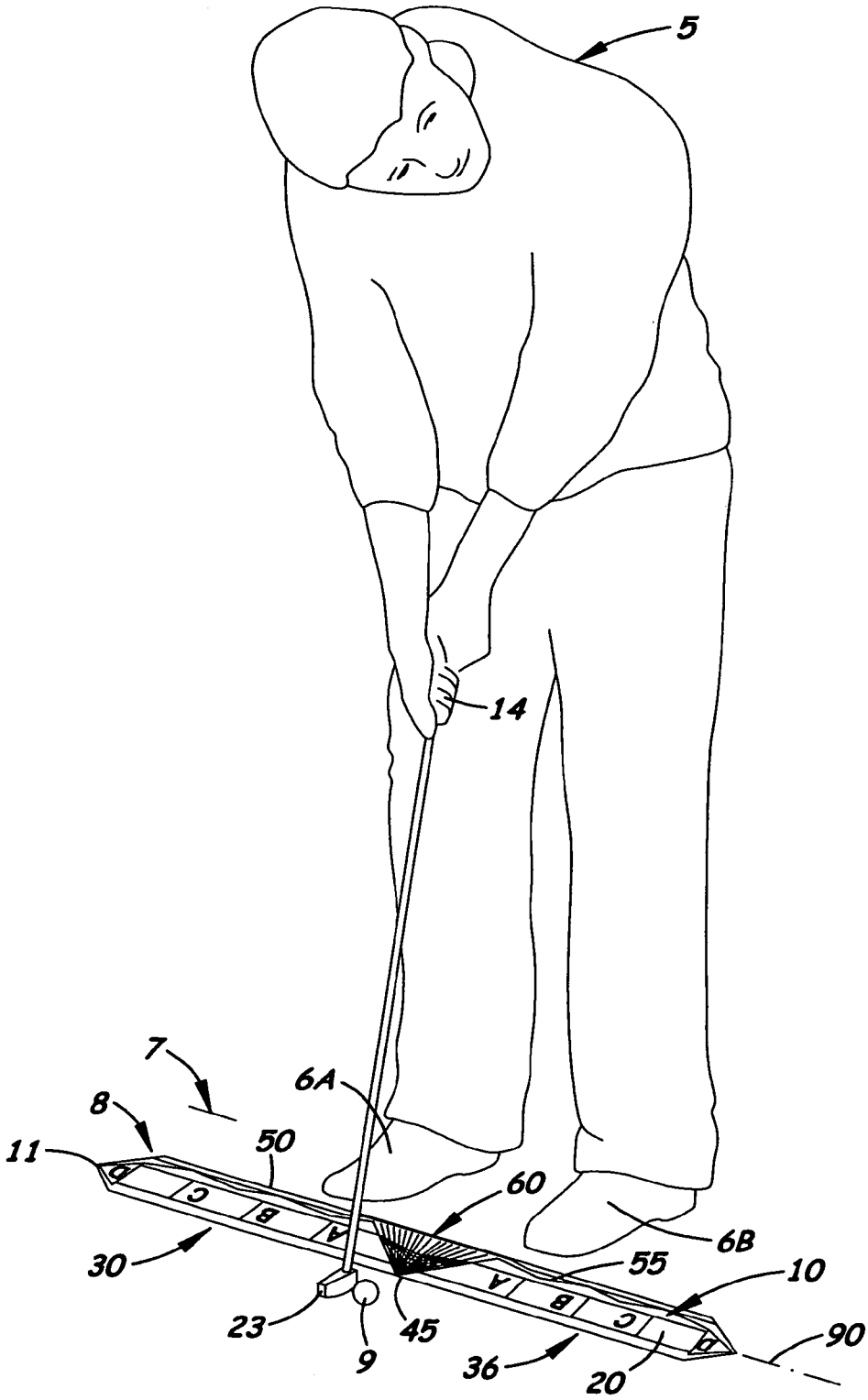
FIG. 1 is a perspective view of a golfer making a putt using the training device described herein.

There is shown in the accompanying Figs., a putting training device 8 used by golfers on a putting green 7, and method. The device 8 includes an elongated planar member 10 made of material capable of being easily folded into a pocket. As shown more clearly on FIG. 2, the planar member 10 is unfolded and positioned on the putting green 7 parallel to the golfer's two feet 6A, 6B. The two feet 6A, 6B are normally, perpendicular to the target line 90.

Printed on the top surface 11 of the planar member 10 is a longitudinally aligned target line indicator 20. Also printed on the top surface 11 are right and left swing force indicators 38, 36, respectively, a center ball indicator 45, and a plurality of right and left foot 19 position indicators 50, 55 respectively. Located adjacent to the center ball indicator 45 is a putter head angle scale 60.

The planar member 10 is made of plastic or laminated paper stock with an imprinted 22 target line indicator 20. In the preferred embodiment, the planar member 10 is approximately 28 inches in length and 3½ inches in width. The right and left swing force indicators 30, 36 are transversely aligned lines 31–33 and 37–39, respectively, imprinted over the target line indicator 20 and on opposite sides of the putter head angle scale 60. In the preferred embodiment, the lines 31–33 and 37–39 are centrally aligned on opposite sides of the scale 60 and equally spaced apart approximately 3½ inches. It should be understood that the lines 31–33 and 37–39 could be spaced apart at other distances. In the preferred embodiment, the right and left foot indicators 50, 55 are formed by two zigzag lines 51, 52 and 56, 57, respectively, formed along the perimeter edge 12 of the planar member 10. The foot indicators 50, 55 are aligned parallel with the target line indicator 20. The lines 51, 52 and 56, 57, for each foot indicator 50, 55 diverge and converge in an alternating manner to create apexes 100, are equally spaced apart along the perimeter edge 12 of the planar member 10. During use, the golfer 5 aligns his or her feet right and left foot 6A, 6B, respectively, with two apexes 100 on opposite sides of the center ball indicator 45 to properly position his or her shoulders and hips over the ball. In the preferred embodiment, the apexes 100 are approximately 3½ inches apart. It should be understood that the lines 51, 52 and 56, 57 and apexes 100 can be replaced with other markers to help the golfer properly position his or her feet.

Figure 2:
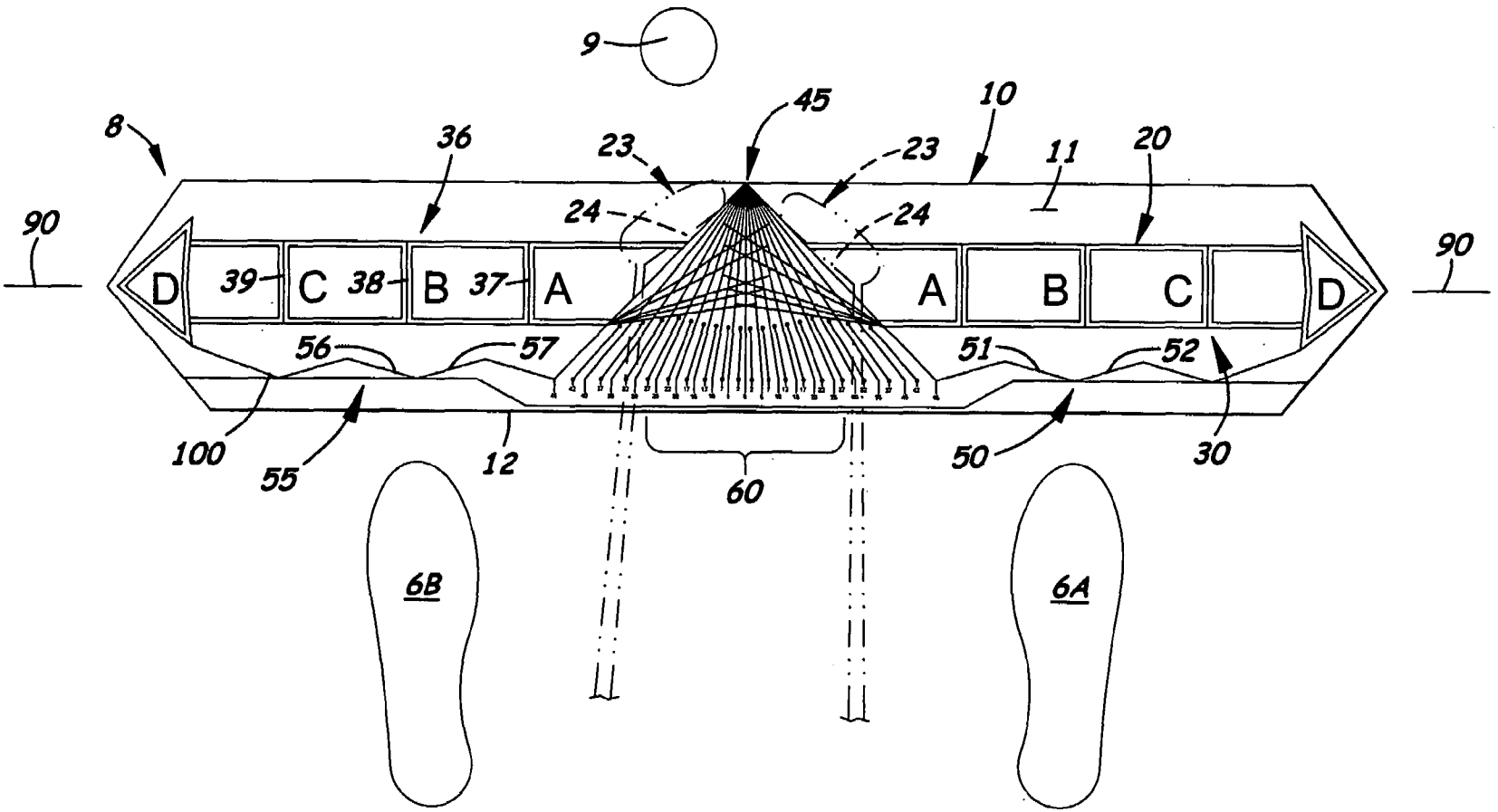
FIG. 2 is a top plan view of the training device placed on a putting green with the golfer's feet aligned with the front and rear foot indicators.

As shown in FIG. 2 the right and left swing indicators 36, 38 may be two index scales 41, 43 located on opposite sides of the reference point 45 and parallel to the target line indicator. In the preferred embodiment, each index scale 41, 43 includes a plurality of marking 42, 44, respectively. The markings are equally spaced apart adjacent to the distal longitudinal edge of the planar member 10.

Figure 3:
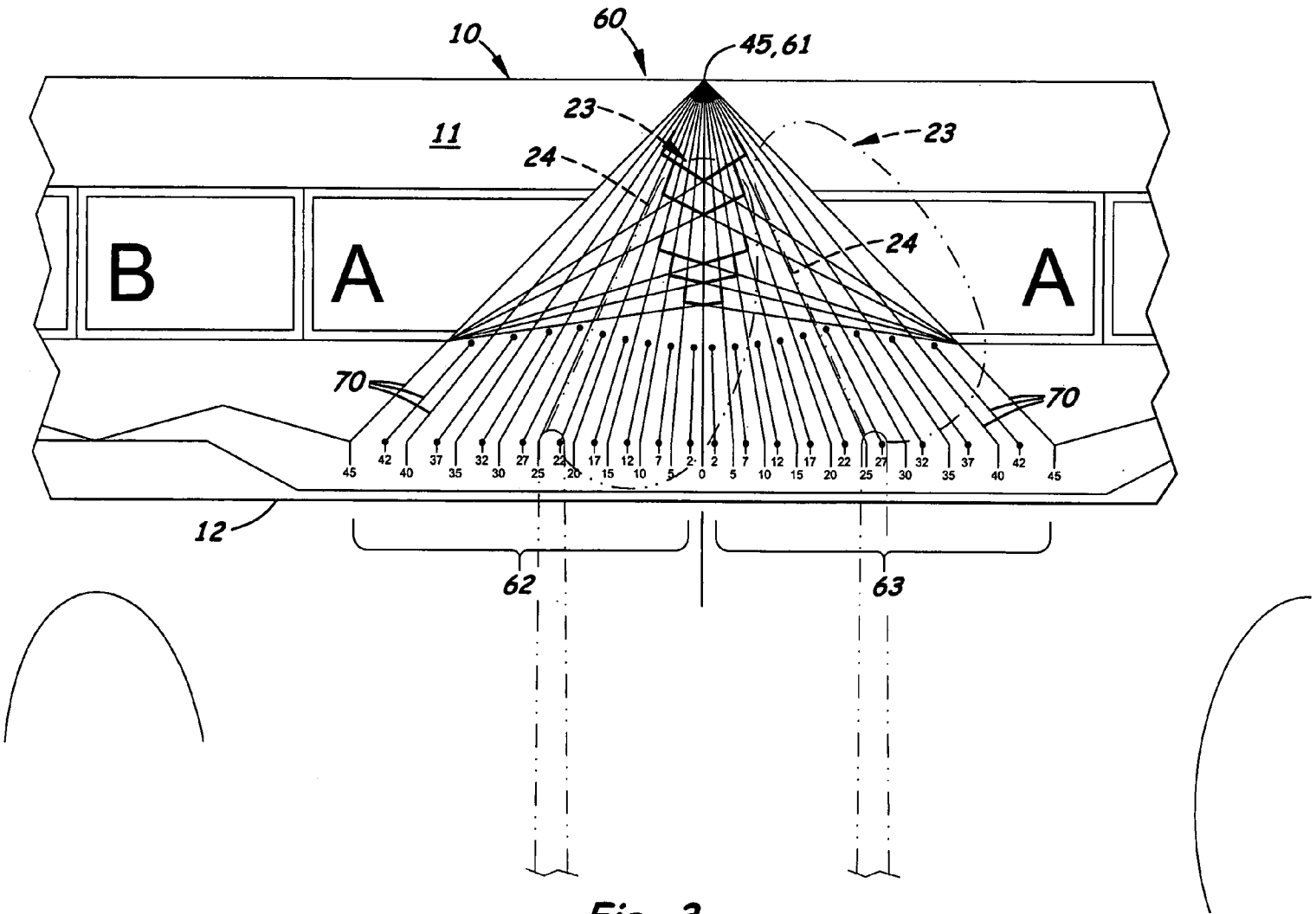
FIG. 3 is a top plan view of the putter head angle guide.
Figure 4:
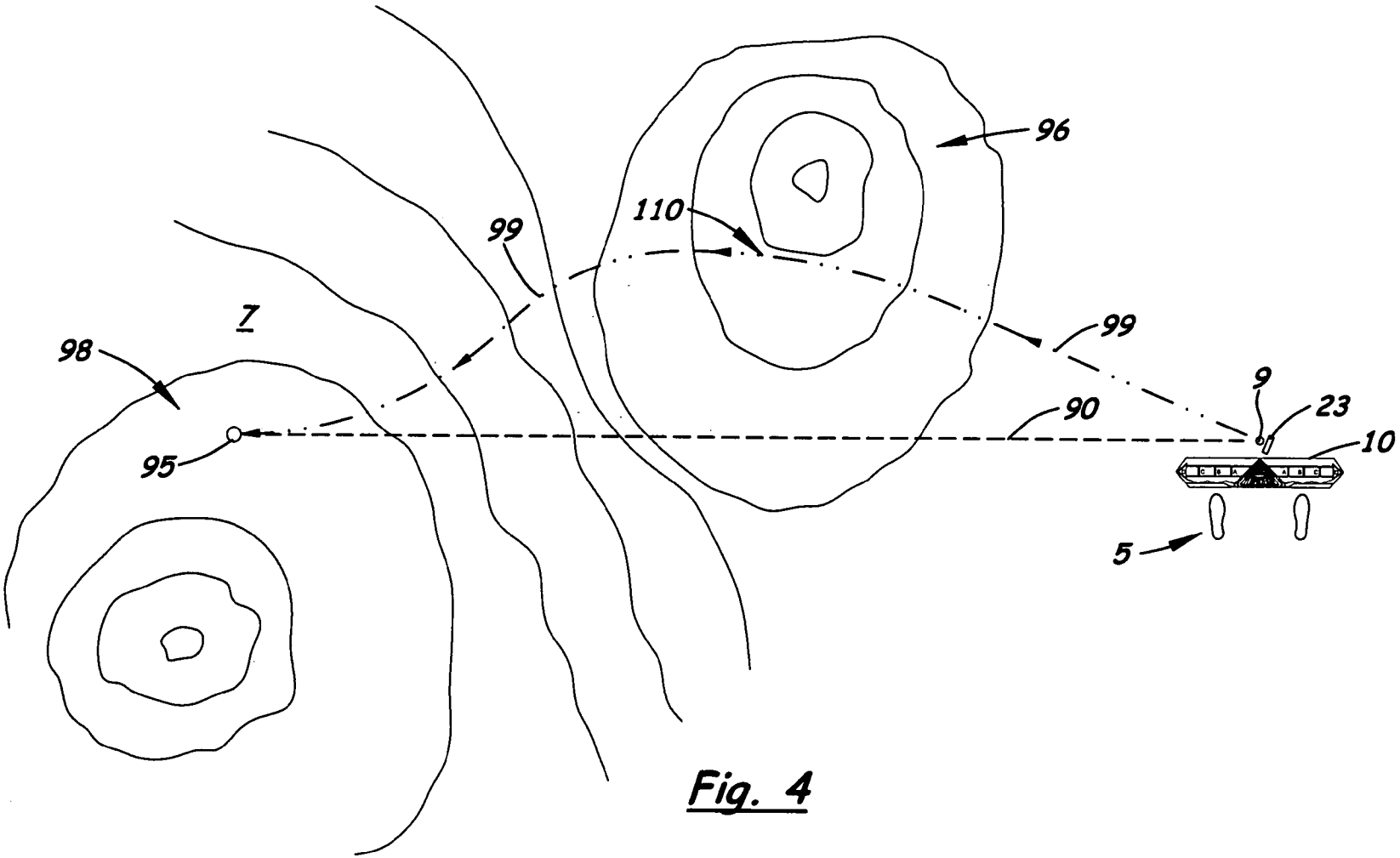
FIG. 4 is a top plan view showing a putt performed on a putting green with two sloped hills located between the golfer and the hole.

The putter head angle scale 60 is centrally located on the planar member 10. As shown in FIG. 3, the putter head angle scale 60 includes a plurality of slope reference lines 70 that terminate at a central reference point 61. In the preferred embodiment, the scale 60 is divided into two smaller scales, an open head scale 62 and a close head scale 63. The two scales 62, 63 radiate in opposite directions from the central reference point 61. The reference lines 70 are radially aligned 2 degrees apart on opposite sides of the reference point 61. During use, the planar member 10 is unfolded on the turf or green between the golfer's feet 6A, 6B and the ball 9. The planar member 10 is aligned so that the target line indicator 20 is longitudinally aligned with the actual target line 90 that extends from the golfer 5 to the hole 95. The center ball indicator 45 is aligned or slightly offset with the center of the ball 9. Next, the golfer 5 inspects the area of the putting green 7 that leads to the hole 95 for lateral slope surfaces 96, 98 that may force the ball 9 to travel towards or away from the hole 95. The golfer 5 then determines projected ball path to the hole 95 and the final slope angle. Once the final slope angle is determined, the golfer 5 then reviews the putter head angle scale 60 to identify the slope reference line 70 that most closely matches the final slope angle.

As discussed above, the final slope angle is the summation of the individual lateral slopes located along the projected ball path that extends between the golfer 5 and the hole 95. When more than one slope surfaces 96 exists between the golfer 5 and the hole 95, the golfer 5 adds or subtracts the slopes 96 together to determine final slope angle, (plus symbol used with uphill slopes and minus symbol used with downhill slopes). The face 24 of the putter is then positioned next to the reference line 70 on the scale 61 or 62 that most closely matches the final slope angle.

Before attempting the putt, the golfer 5 also inspects the green for longitudinally aligned upward slopes or downward slopes along the projected ball path that increases or decreases the speed of the ball 9. The golfer then inspects the green's texture and moisture content.

After the final slope angle, the presence of longitudinally aligned upward or downward slopes, the texture and the moisture issues have been considered, the golfer 5 then positions himself or herself on the side of the planar member 10 opposite the ball 9. He or she then aligns the face 24 of the putter 23 with the slope reference line 70 that most closely matches the final slope angle. He or she then grips the handle 14 so that the angle of the face 24 is maintained as the putter 23 is swung along the target line indicator 20. For a right-handed golfers, the face 24 of the putter 23 is opened when the putting green slopes downward right to left. When the putting green slopes downward left to right, the face 24 of the putter 23 is closed. For left-handed golfers, the opened or closed orientation of the face 24 of the putter 23 is reversed.

Before putting, the golfer 5 must also determine the amount of force applied to the ball by using the force indicator 30 or 36 on the end of planar member 10 opposite the hole. As mentioned above, the lines 31–33 and 37–39 or markings 42, 44 on the force indicators 30, 36, respectively, are equally spaced apart. Based on a normal, constant putting swing acceleration of approximately 1–2 ft. per second, each reference line or marking represents the starting location of the putter along the backswing. Reference lines or markings closer to the center axis produce shorter backswings and thus resulting in, less force being applied to the ball. Reference lines or markings further from the center axis produce longer backswings with greater force being applied to the ball. While golfers are instructed to swing the putter 23 at a constant acceleration and to follow through, the accelerator of the putter varies between golfers. For the typical golfer, the distance between adjacent reference lines represents the amount of force needed to make the ball roll approximately 2 yards on a flat green.

For other golfers, the distance between reference lines or markings may represent greater or lessor distances. During the initial use of the device, the golfer must calibrate the reference lines or markings with his or her putting swing speed. During use, the golfer 5 estimates the distance needed to reach the hole 9 or the apex 110 of the ball path 99 and then uses the force indicators 30 or 36 to produce the proper force. It is important to note that the amount of force exerted on the ball 9 is determined by the distance the ball 9 must travel from the golfer 5 to the apex 110) of the path 99 of the ball 9 when it hits a desired angle equal to the slope reference line 70. If the ball 9 must roll over a lateral slope to reach the hole 95, the golfer 5 hits the ball 9 with sufficient force so that the ball 9 travels in an arc. The ball 9 should be hit with sufficient force so that when the ball 9 reaches the apex 110 of the arc, the ball 9 then rolls towards the hole 95. If the ball 9 must roll in a straight path and over one or more over longitudinally aligned slopes to reach the hole, the golfer must hit the ball with sufficient force to accommodate the effect of gravity on the ball 9.

In the prior art the golfer 5 changes the placement of his or her feet 6A, 6B so that the swing path of the putter 23 is aligned with the projected ball path 99. If slopes exist around the hole, the golfer's feet 6A, 6B are aligned with the projected ball path 99 to the high or low apex 110 spot of the ball's arc to the hole 95. In the method disclosed herein, the swing path of the putter 23 is always longitudinally aligned with the target line indicator 20 that extends from the ball 9 to the hole 95. Only the angle of the face 24 of the putter 23 is adjusted to match the final slope angle.

Using the above device, a method for putting is disclosed, comprising the following steps:

a. selecting a putter training device that includes an elongated planar member with a longitudinally aligned target line indicator, right and left swing force indicators longitudinally aligned with said target line indicator, a center ball indicator, and a putter head scale;

b. placing said training device on the ground so that said target line indicator is longitudinally aligned with the target line that extends from the ball to the hole;

c. determining a projecting path line from the ball to the hole;

d. determining the angle of lateral slopes between the ball and the hole;

e. adding the angles of lateral slopes together to determine a final slope angle;

f. aligning the putter with a reference line that substantially matches said final slope angle;

g. determining the amount of force to hit the ball and, h. swinging the putter along the target line indicator while holding the putter with the face of said putter aligned with said reference line that matches said final slope angle.

In compliance with the statute, the invention described herein has been described in language more or less specific as to structural features. It should be understood, however, that the invention is not limited to the specific features shown, since the means and construction shown is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A method for putting is disclosed, comprising the following steps:

a. selecting a putter training device, that includes an elongated planer member with a longitudinally aligned target line indicator, right and left swing force indicators longitudinally aligned with said target line indicator, a center ball indicator, and a putter head scale;

b. placing said training device on the ground so that said target line indicator is longitudinally aligned with the target line that extends from the ball to the hole;

c. determining a projecting path line from the ball to the hole;

d. determining the angle of lateral slopes between the ball and the hole;

e. adding the angles of lateral slopes together to determine a final slope angle;

f. aligning the putter with a reference line that substantially matches said final slope angle;

g. determining the amount of force to hit the ball and, h. swinging the putter along the target line indicator while holding the putter with the face of said putter aligned with said reference line that matches said final slope angle.

* * * * *